US009265351B2

(12) United States Patent
Koorey

(10) Patent No.: US 9,265,351 B2
(45) Date of Patent: Feb. 23, 2016

(54) BED LIFTING SYSTEM

(76) Inventor: John Koorey, Manly (AU)

( * ) Notice: Subject to any disclaimer, the term of this patent is extended or adjusted under 35 U.S.C. 154(b) by 1616 days.

(21) Appl. No.: 12/673,646

(22) PCT Filed: Aug. 12, 2008

(86) PCT No.: PCT/AU2008/001165

§ 371 (c)(1),
(2), (4) Date: May 3, 2010

(87) PCT Pub. No.: WO2009/021281

PCT Pub. Date: Feb. 19, 2009

(65) Prior Publication Data

US 2010/0205748 A1 Aug. 19, 2010

Related U.S. Application Data

(60) Provisional application No. 61/012,805, filed on Dec. 11, 2007.

(30) Foreign Application Priority Data

Aug. 13, 2007 (AU) ..... 2007904344

(51) Int. Cl.

| | |
|---|---|
| ***A47C 19/04*** | (2006.01) |
| ***A61G 7/012*** | (2006.01) |
| *A61G 7/015* | (2006.01) |

(52) U.S. Cl.
CPC ..... *A47C 19/045* (2013.01); *A47C 19/04* (2013.01); *A61G 7/012* (2013.01); *A61G 7/015* (2013.01)

(58) Field of Classification Search
CPC ..... A61G 7/002–7/018; A47C 19/04–19/045
USPC ..... 5/658, 662, 652, 733, 646
See application file for complete search history.

(56) References Cited

U.S. PATENT DOCUMENTS

| | | | | |
|---|---|---|---|---|
| 3,887,950 | A | 6/1975 | Wachsman | |
| 8,122,536 | B2 * | 2/2012 | Peixin et al. | 5/174 |

FOREIGN PATENT DOCUMENTS

| | | | |
|---|---|---|---|
| EP | 0637424 | A1 | 2/1995 |
| ES | 2269010 | A1 | 3/2007 |
| FR | 2602655 | A1 | 2/1988 |
| FR | 2798053 | A1 | 3/2001 |
| NL | 9401725 | A | 6/1996 |
| WO | WO 2006063410 | A1 * | 6/2006 |

* cited by examiner

*Primary Examiner* — Peter M Cuomo
*Assistant Examiner* — Brittany Wilson
(74) *Attorney, Agent, or Firm* — The Webb Law Firm

(57) ABSTRACT

A bed lifting system is provided for lifting a bed above a surface. The system comprises a frame adapted for supporting the bed. The frame is arranged for interacting with a lifting mechanism capable of elevating the frame. A base that is adapted for inter-engaging with the frame whereby the base can support the frame over the surface independently of the lifting mechanism.

13 Claims, 7 Drawing Sheets

BED LIFTING SYSTEM

CROSS-REFERENCE TO RELATED APPLICATIONS

This application is the United States national phase of International Application No. PCT/AU2008/001165 filed Aug. 12, 2008, which claims priority to Australian Patent Application No. 2007904344 filed Aug. 13, 2007 and U.S. Provisional Patent Application Ser. No. 61/012,805 filed Dec. 11, 2007, the disclosures of which are hereby incorporated in their entirety by reference.

BACKGROUND OF THE INVENTION

1. Field of the Invention

A bed lifting system is disclosed that finds particular though not exclusive application in commercial and domestic contexts.

2. Description of the Related Art

Conventionally, when a bed is made, the user must bend over because the bed height is usually much lower than the waist height of most persons. This can cause undue strain to the user, in particular commercial users, who must make many beds for long periods of time. In addition, beds that abut one or more walls, or other surfaces such as a bed head, can create an even more cumbersome situation for the user and increase the risk of injury or strain on the user's back.

SUMMARY OF THE INVENTION

In a first aspect there is provided a bed lifting system for lifting a bed above a surface comprising:

a frame having at least one outwardly extending arm arranged to extend from or retract into the frame to vary the width of the frame, the frame arranged for interacting with a lifting mechanism capable for elevating the frame to support a bed; and a base that is adapted for inter-engaging with the frame whereby the base can support the frame over the surface independently of the lifting mechanism.

In a second aspect there is provided a bed lifting system for lifting a bed above a surface comprising a frame adapted for supporting the bed and for engaging abase of the bed, the frame having at least one outwardly extending arm arranged to extend from or retract into the frame to vary the width of the frame, the frame arranged for interacting with a lifting mechanism that is capable of lifting the frame between:

an extended position in which the frame can support the bed over the surface independently of the base; and a collapsed/retracted position in which the base can support the bed over the surface independently of the lifting mechanism.

In both the first and second aspects the configuration of the base is such as to support the bed in a usual manner, but the configuration also allows actuation of the lifting mechanism to raise the bed for bed-making, cleaning etc. The base can also be configured to assume the form of a mattress box base or separate frame, and yet can still interact with and be lifted by the lifting mechanism. Thus, traditional appearances and aesthetics can be maintained.

In the second aspect, the frame can also be adapted for retrofitting to an existing base (eg. a known mattress box base or a known separate frame). To enable such retro-fitting the box base or frame may require in-situ modification.

Typically in the first aspect the base is lifted by the lifting mechanism together with the frame. Typically in the second aspect the frame is lifted by the lifting mechanism, with the base remaining at the surface during such lifting.

In one form of the bed lifting system, the base comprises opposing elongate side members for positioning at opposing respective sides of the frame, each side member being adapted for resting on the surface. Such side members can define a separate frame-type of base. In the first aspect the side members can, in addition to being liftable by the lifting mechanism, in a collapsed/retracted configuration of the lifting mechanism, support the bed on a floor/surface to provide a stable base for the bed mattress and frame. In the second aspect the side members may, in the collapsed/retracted configuration of the lifting mechanism, support the bed on a floor/surface independently of the frame to provide a stable base for the bed mattress and frame, although usually they cooperate with the frame to support the bed.

In this one form of the system, the base may further comprise a plurality of detachable supports adapted for being attached to either or both ends, and/or to a mid-region, of the frame, with each support also being adapted for resting on the surface. The detachable supports can be employed as necessary for wide beds (such as king and super-king beds) to provide end and mid-region support to the bed mattress and frame. However, if not needed, the supports can simply be detached and removed.

In an alternative variation of this form, the detachable supports can be engaged to a lower portion of the frame, and can extend upwardly from the surface to support an upper portion of the frame in use (ie. in a collapsed/retracted configuration of the lifting mechanism). In this alternative variation the supports may optionally extend upwardly from the surface to support an underside of the bed in use.

In the first aspect, each elongate side member can be adapted for resting on the surface in use through a plurality of spaced legs which extend downwardly to the surface. The spaced legs function to transmit the load of bed mattress and frame, as well as any user(s) and bedding etc, to discrete points, and yet can still allow for under-bed access for cleaning, or to access the lifting mechanism etc.

In the second aspect, each elongate side member can rest on the surface in use. In one embodiment of this arrangement each side member may comprise a plurality of spaced posts which can extend upwardly to engage and support the frame (and/or the bed underside) in the collapsed/retracted configuration of the lifting mechanism. Again, the posts transmit the load of the bed mattress, frame, users, bedding etc to a side member which can then evenly distribute such load throughout its length. This distribution can help to minimise wear and tear on the surface, particularly to carpet or a polished timber surface.

This embodiment of the second aspect can also make use of the detachable supports, which may be used in a "normal" mode whereby they are detachably connected to an upper frame portion to extend downwardly, or in an "inverted" mode whereby they are detachably connected to an lower frame portion to extend upwardly.

In an alternative form of both the first and second aspects, the base can comprise opposing elongate side panels for positioning at opposite respective sides of the frame, each side panel being arranged for resting on the surface. Such side panels can define part of a box-type base which, in addition to being liftable by the lifting mechanism can, in a collapsed/retracted configuration of the lifting mechanism, support the bed on a floor/surface to provide a stable base for the bed mattress and frame. The side panels can also lend a traditional appearance to the base and thus can replace an existing box base.

In this alternative form, the base may further comprise opposing end panels for positioning at opposite respective frame ends, each end panel being arranged for resting on the surface and adapted for interacting with the side panels to enclose the frame. The end panels can thus complete a box-type base. Such a base can also enclose the space beneath the bed to hide the lifting mechanism and to keep out dust etc. However, actuation of the lifting mechanism can still allow for under-bed access for cleaning, and to access the lifting mechanism etc.

In a further form, the frame can comprise outwardly extending arms at opposing frame ends. Then, opposing ends of the side members or panels can be adapted for engaging remote ends of such arms. The arms can be length adjustable (eg. they may telescopically slide into and out of the frame), whereby a single frame type can be deployed for and can adapt to different bed sizes.

In one embodiment of this further form, opposing ends of the side members can be engaged to the arm ends via complementary fixing brackets mounted at each of the member and arm ends. Such brackets can provide a simple means of fastening the side members to the arms.

In this embodiment the complementary fixing brackets can comprise one or both of:

- an in-use vertical plate affixed to each of the side member and arm end, which plates can be arranged for fixing to each other;
- an in-use horizontal plate affixed to each of the side member and arm end, which plates can be arranged for fixing to each other.

In an alternative embodiment of this further form, the opposing ends of the side panels can be engaged to the arm ends via a fixing bracket mounted at each arm end. The fixing bracket can comprise one or both of:

- an in-use vertical plate affixed to the side member and arranged for fixing to an inside face of the panel;
- an in-use horizontal plate affixed to the side member and arranged for fixing to an upper edge of the panel.

Such fixing brackets may also allow for attachment of the end panels thereto to further define the box-type base. For example, the brackets can be multi-faceted to also allow for connection of adjacent panels. Also, the side panels may optionally comprise a corresponding plate arranged at the panel for fixing to a corresponding bracket at each arm end.

In a third aspect there is provided a base that is adapted for engaging a bed lifting apparatus such that, when engaged, the base is able to, independently of the apparatus, support a bed on a surface.

The base is thus able to support the bed in a usual way whilst the bed lifting apparatus is in a non-activated state (eg. collapsed/retracted), allowing the base to simulate a known form of bed base. However, in the first aspect, such a base can move with the bed lifting apparatus when activated (eg. from a collapsed/retracted position to an extended position). Alternatively, in the second aspect, such a base can remain at the surface when the bed lifting apparatus is activated, whereby the base supports the bed (and optionally the frame) when the bed lifting apparatus is in the collapsed/retracted position.

In one embodiment of the third aspect, the base can comprise opposing elongate side members or panels for positioning at opposing respective sides of a frame mounted to the lifting apparatus. Each side member or panel can be adapted for resting on the surface when the lifting apparatus is in a collapsed/retracted position. As with the first aspect, such side members and panels can replace (and simulate) known bed support frames/box frames. As with the second aspect, such side members and panels can be provided by known bed support frames/box frames that are modified (eg. in-situ) to enable them to be connectedly engaged to the lifting apparatus.

In addition, when the lifting mechanism is not in use (ie. non-activated) the base can protect, cover and hide the lifting mechanism (eg. to keep the mechanism clean, and to prevent tampering or inadvertent access).

In a further embodiment of the third aspect, the base can further comprise end supports or panels for positioning at opposing respective ends of the frame and adapted for resting on the surface when the lifting apparatus is in a collapsed/retracted position. As with the first and second aspects the end supports/panels can, especially with wider/larger beds, distribute the weight of the bed in a uniform manner and increase stability of the bed in the collapsed/retracted position. The end panels can also complete the box structure.

In other respects, the side members, end supports, side and end panels can be as defined in the first and second aspects.

In a fourth aspect there is provided a base frame for mounting to a bed support frame that is in turn mounted to a bed lifting mechanism, the base frame comprising a plurality of elongate members adapted for inter-engaging with the bed support frame, whereby the elongate members can support the bed support frame on a surface independently of the bed lifting mechanism.

In the fourth aspect, the base frame can be defined by the "base" of the first and second aspects, and the bed support frame can be defined by the "frame" of the first and second aspects. Such a base frame can support the bed in a collapsed/retracted position of the bed lifting mechanism, but can also support the bed support frame in the lifting mechanism collapsed/retracted position. Again, as with the first and second aspects, the base frame can assume the form of a mattress box base or a separate frame to maintain traditional appearances and aesthetics. As with the first aspect, the base frame can be lifted by the lifting mechanism.

The base frame of the fourth aspect can be formed from the side members and end supports, or the side and end panels, as defined in the first and second aspects.

In a fifth aspect there is provided a support member for mounting to a bed support frame that is in turn arranged for interacting with a bed lifting mechanism, the support member comprising a mounting bracket adapted at one end for location at the frame, the bracket extending from an elongate leg that is arranged for resting on a surface when the lifting mechanism is in a collapsed/retracted position.

Such a support member can find selective use at either end and at a mid-region of the bed support frame to provide an effective and yet easy-to-retrofit way of increasing the load bearing capacity of the frame (eg. when used with a wider/larger/heavier bed). In addition, the mounting bracket can allow for easy attachment/detachment of the support member (eg. when the bed lifting mechanism is transferred to a larger/smaller bed etc).

In an alternative mode of use of the support member, when the bed support frame comprises an in-use upper frame portion and a lower frame portion, the mounting bracket can be located at the lower frame portion and, when the lifting mechanism is in the collapsed/retracted position, the elongate leg can extend upwardly to rest at an underside of the bed and/or at the upper frame portion.

The support member can be defined by the detachable support of the first and second aspects.

DETAILED DESCRIPTION OF THE PREFERRED EMBODIMENTS

Figure 1:
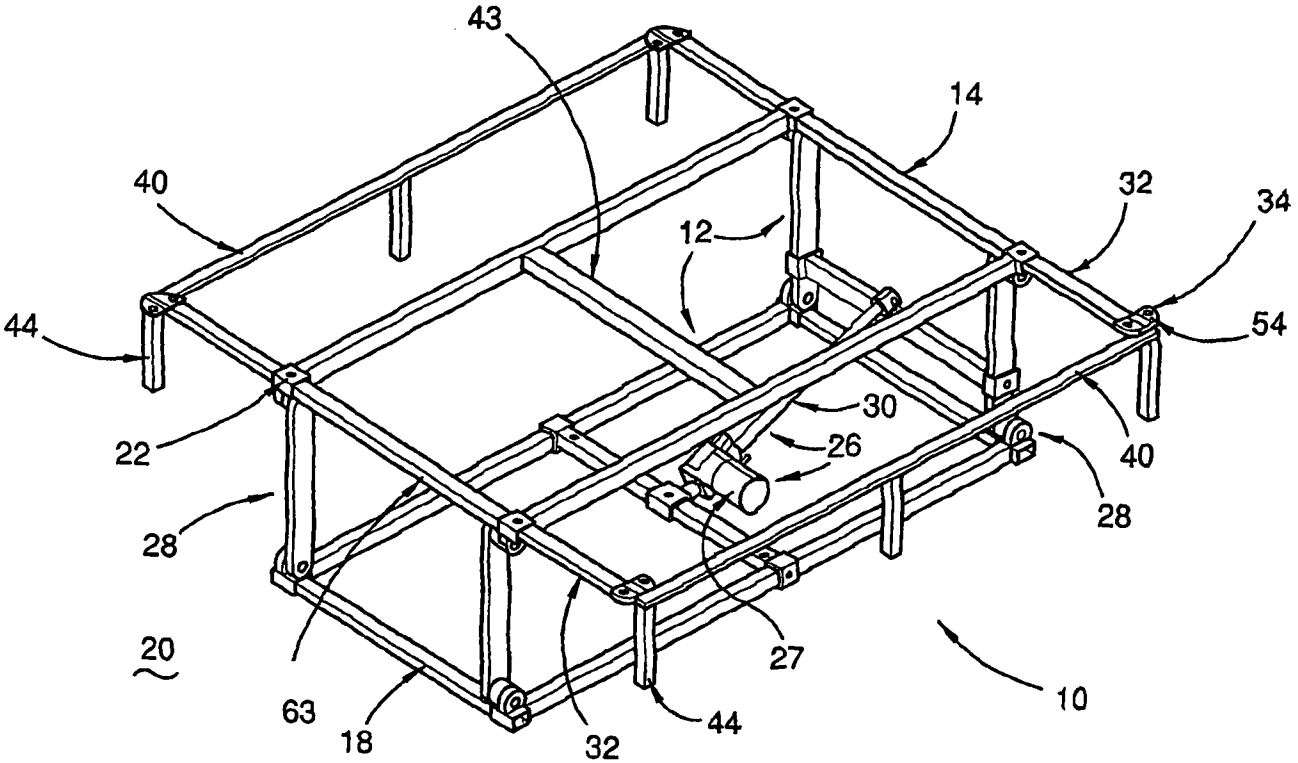
FIG. 1 is a perspective view of a bed lifting system according to a first embodiment in an extended orientation.
Figure 2:
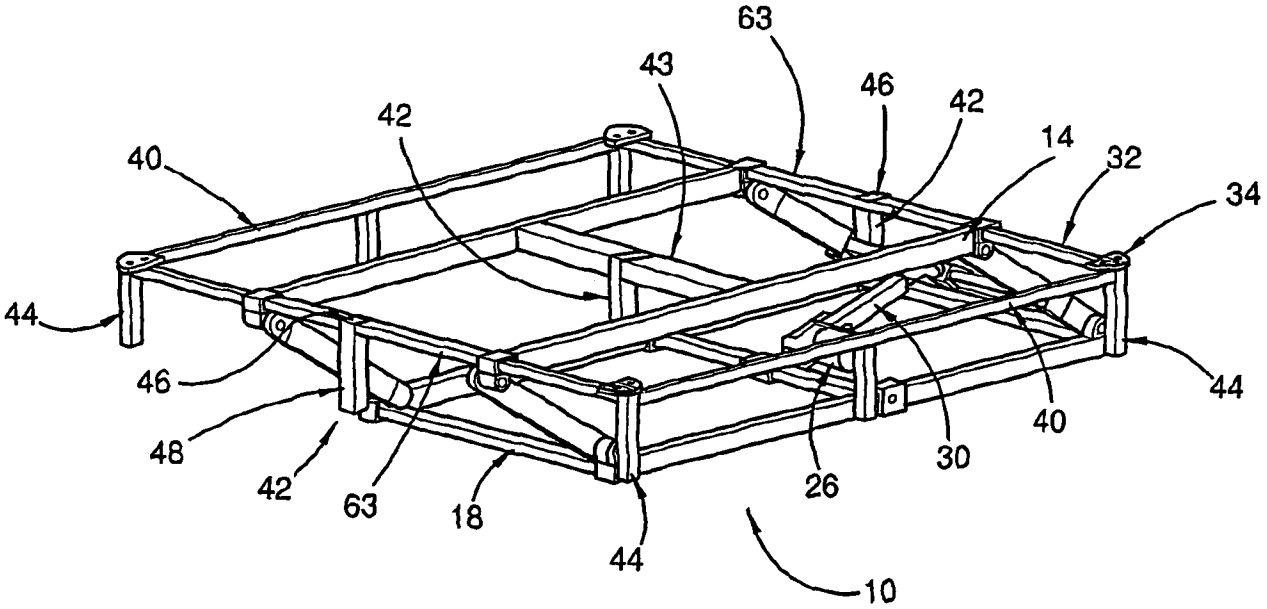
FIG. 2 is a perspective view of the system of FIG. 1 in a partially collapsed/retracted orientation.
Figure 3:
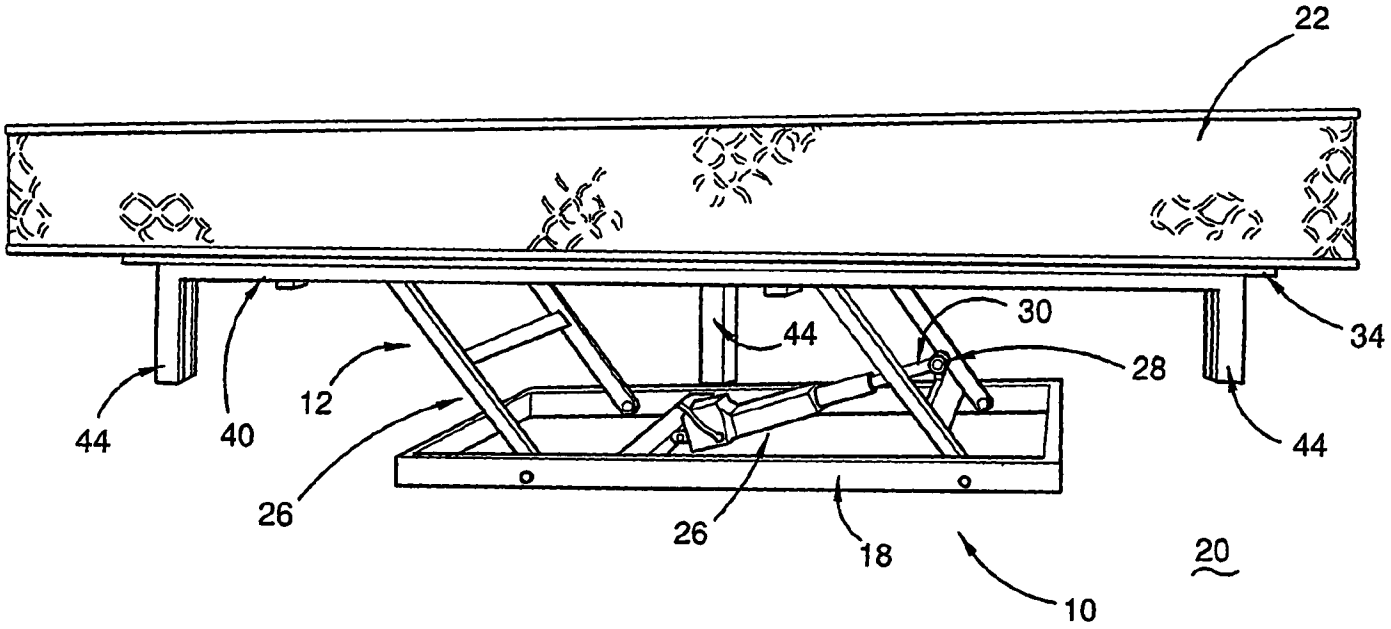
FIG. 3 is a side perspective view of the system of FIG. 1 in use, in an extended orientation and with a mattress positioned thereon.

Referring to the drawings, a bed lifting system (denoted by 10 in FIGS. 1 to 4 and denoted by 10' in FIGS. 5 to 7) includes a bed lifting mechanism in the form of a bed hoist 12. The hoist 12 is adapted for lifting an upper frame part 14, as well as lifting a separate bed frame in the form of a distinct and separate framework (FIGS. 1-4) or a mattress box base (FIGS. 5-7), as hereafter described. The hoist comprises a lower frame part 18 for resting on a floor 20, with the upper frame 14 being adapted for location at the underside of, to mountingly receive thereat, a mattress base 22 (see eg. FIG. 3).

Figure 4:
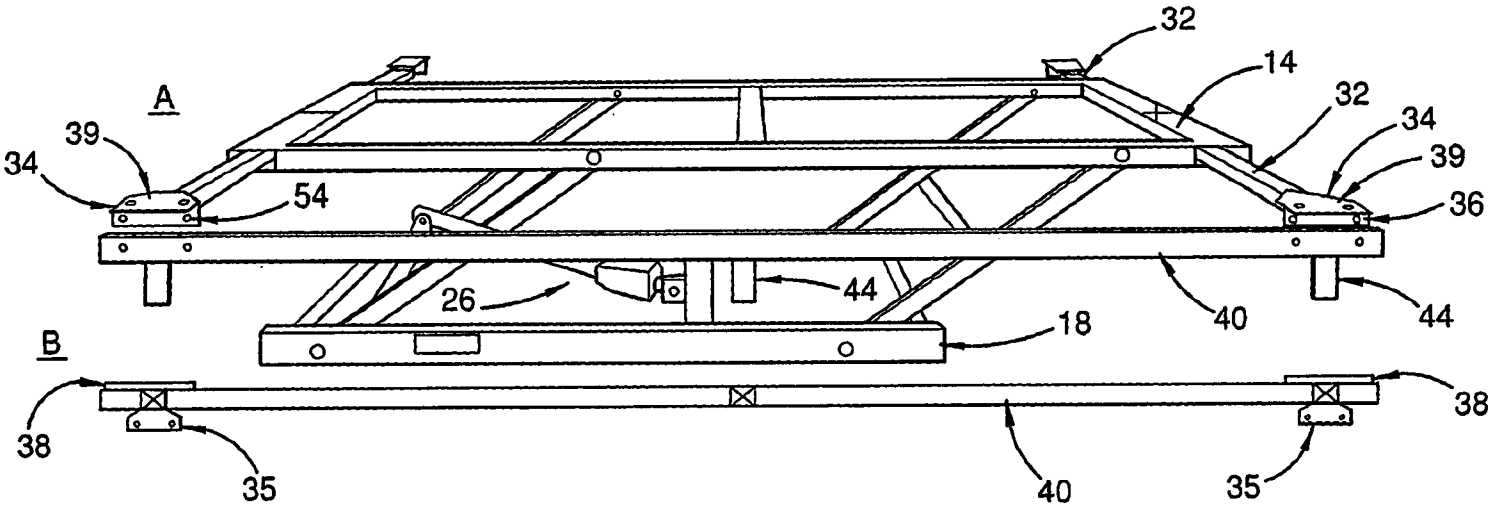
FIG. 4A is a side perspective view of the system of FIG. 1 but with one side portion of a base frame detached from a bed frame.
FIG. 4B is a plan view of the side portion of FIG. 4A.
Figure 5:
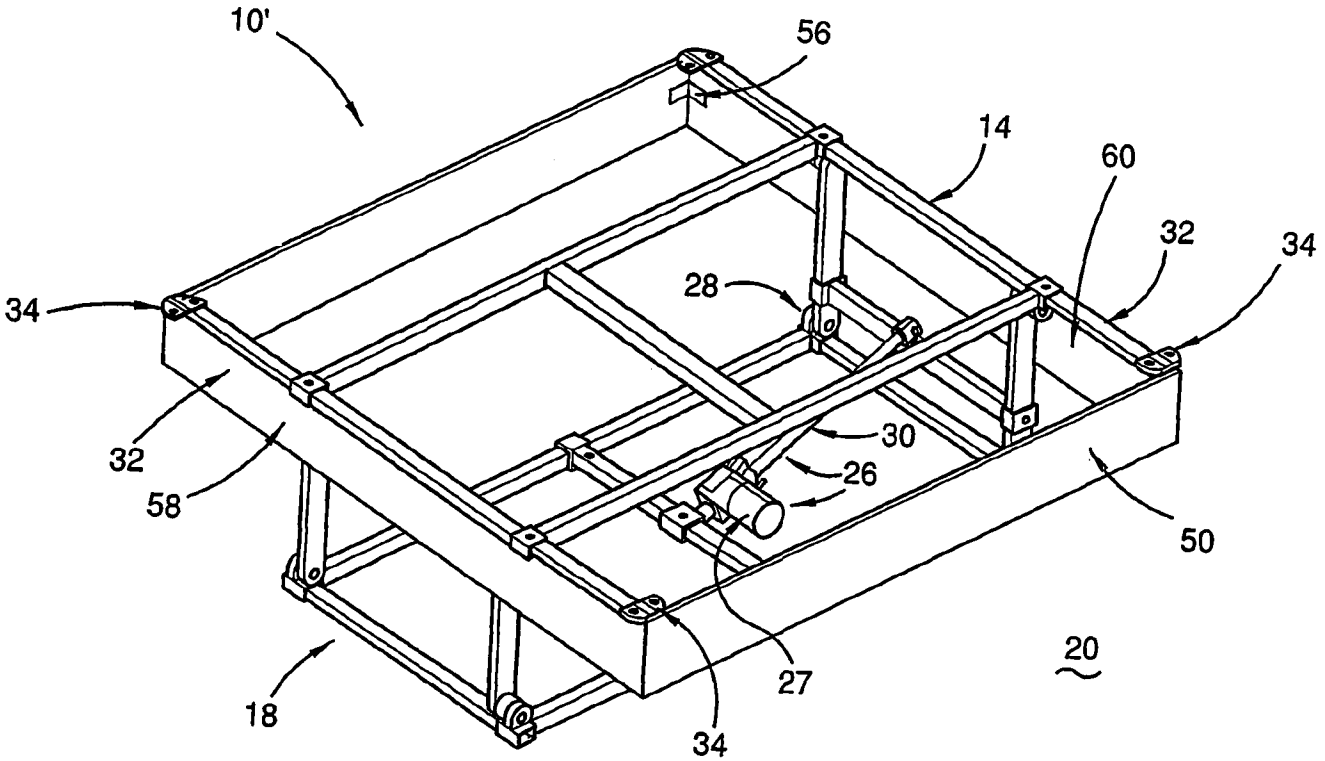
FIG. 5 is a perspective view of a bed lifting system according to a second embodiment in an extended orientation.
Figure 6:
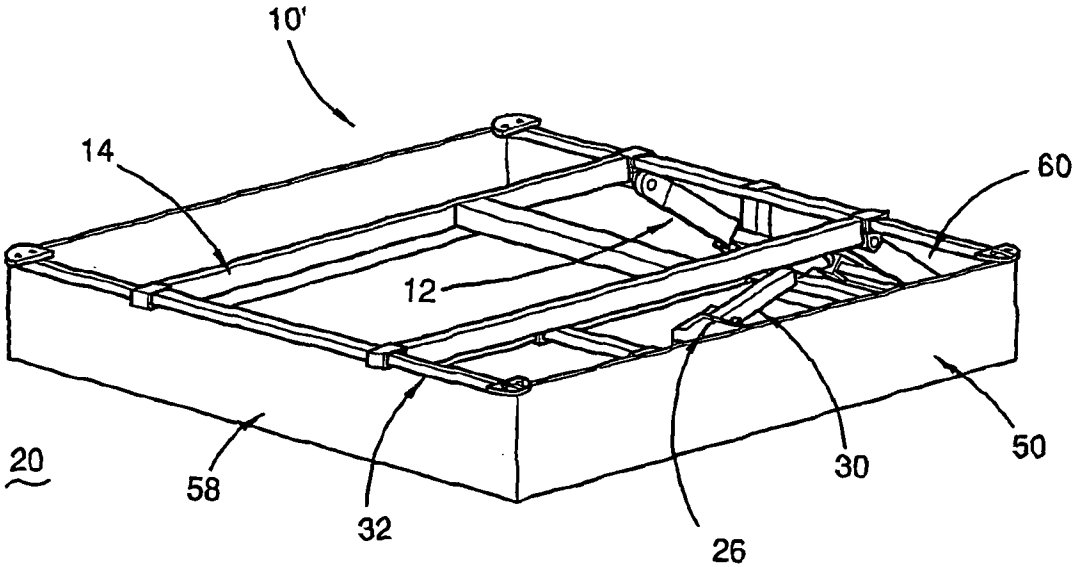
FIG. 6 is a perspective view of the system of FIG. 5 in a collapsed/retracted orientation.
Figure 7:
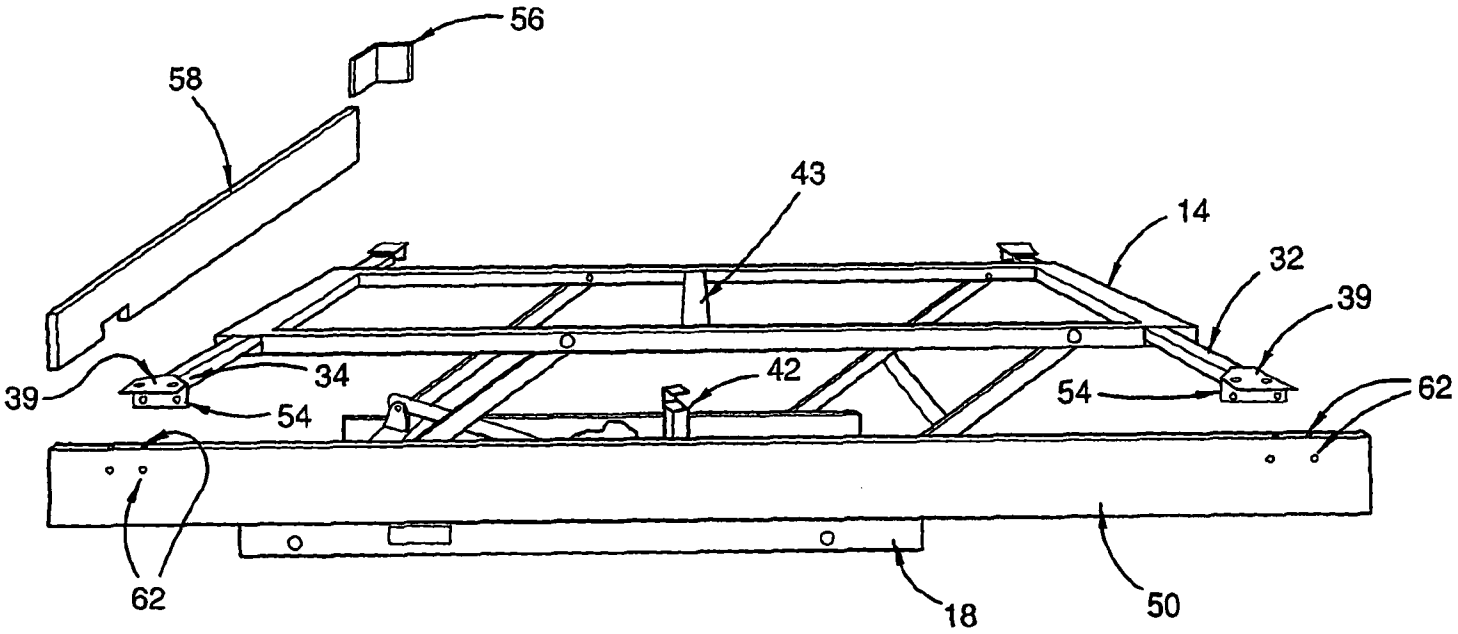
FIG. 7 is a side perspective view of the system of FIG. 5 but with side and end panels of the base frame detached from the bed frame.

The separate bed frame to be lifted by the hoist 12 can either simulate or be defined by the distinct and separate framework of FIGS. 1-4 or the mattress box base of FIGS. 5-7. In addition, when the hoist is in a collapsed/retracted position (FIGS. 2 & 6), the separate bed frame can support the upper frame 14 independently of the hoist 12.

An actuator mechanism 26 is provided for operating between the lower frame 18 and the upper frame 14 to move the upper frame away from or towards the lower frame and thereby raise or lower the mattress base 22 (FIG. 3). The actuator can be remotely actuated by a user and includes an electrical stepper motor 27. In some examples, the motor is housed in an electrostatic shield to protect the motor from electrostatic noise or interference. The hoist 12 further comprises a pantographic linkage 28 that extends between and is pivotally coupled to each of the upper and lower frames, with the linkage being moved by an extendible/retractable arm 30 of actuator 26.

The framework of FIGS. 1-4 comprises a pair of elongate side members 40 that are each detachably mounted with respect to a respective long side of the upper frame 14. Each side member 40 comprises three spaced leg extensions 44 extending downwardly for resting on the floor 20 when the hoist 12 is in its collapsed/retracted position (FIG. 2) to thereby support the upper frame 14 independently of the hoist 12.

The framework of FIGS. 1-4 further comprises a number of supports 42 that can each be detachably mounted to respective ends 63 of the upper frame 14, and optionally to a transverse cross bar 43 located in a mid-region of upper frame 14. The supports 42 are typically evenly spaced from opposing leg extensions 44 of the side members 40. Each support 42 is detachably mounted via a clip-on attachment saddle 46 that can optionally be screwed or bolted to the upper frame. Each support also has a leg portion 48 extending downwardly in use from saddle 46 towards the floor 20. Thus, in co-operation with the legs of side members 40, the legs 48 independently support the upper frame on the floor when the hoist is collapsed/retracted. The supports 42 may optionally be mounted to the side members 40 (eg. intermediate or in place of the leg extensions 44).

The upper frame 14 further comprises a plurality of traversing arms 32 that can telescope and slide transversally from the upper frame to support the framework of FIGS. 1-4 or the box base of FIGS. 5-7, and to underlie and support the mattress base 22. Each traversing arm has one or more flange brackets 34 at its distal and that are adapted for the secure, load-baring fastening of the framework or box base thereto, and that can also support the mattress base 22.

In the embodiment of FIG. 4 it will be seen that the flange brackets 34 are defined by a vertical plate 54 having a series of apertures defined therein. This plate is adapted to face and align with apertures of a corresponding plate 38 attached to an inside face of each side member 40 (as best shown in FIG. 4B) so that fasteners (e.g. screws, bolts, pins etc) can be introduced therethrough.

The flange brackets 34 also include a horizontal plate 39 (see FIG. 4B) having apertures therein to align with a corresponding horizontal plate 35 of side member 40, again so that fasteners (e.g. screws, bolts, pins etc) can be introduced therethrough. Such fasteners can also extend up into (to fasten) an overlying mattress base 22.

The flange brackets 34 provide a rapid means of joining the side members 40 to the arms 32, thereby securely mounting the members with respect to the upper frame 14. In use, and when so mounted, the side members, in conjunction with the supports 42, also simulate the appearance and function of a distinct and separate bed frame.

Reference will now be specifically made to the bed lifting system 10' shown in FIGS. 5 to 7, where like reference numerals will be used to denote similar or like parts. In this embodiment each of the traversing arms 32 of the upper frame is adapted for fastening engagement with a simulated box base comprising elongate side panels 50. Each side panel is again detachably mounted with respect to a respective long side of the upper frame 14. Each panel extends towards the floor and provides support for the upper frame 14 independently of the hoist 12 when the when the hoist is collapsed/retracted (ie. a lower edge of the panel then rests on the floor 20).

As best shown in FIG. 7, the vertical plate 54 of each bracket 34 may be secured (eg. by screwing) directly to an inside face of side panel 50, or a respective securing plate can be provided thereat. The horizontal plate 39 of each bracket 34 may be secured (eg. by screwing) directly to an upper face (edge) of side panel 50, or again a respective securing plate can be provided thereat.

Pre-formed apertures 62 can also be provided in the panels that align with apertures of the plates 54 and 39 to facilitate the easy introduction of fasteners. Again, a rapid, secure and load-bearing fastening of the side panels with respect to the upper frame is achieved.

To complete the appearance of the box base, each side panel 50 can be releasably attached via respective corner joint pieces 56 to opposing front 58 and end 60 panels so as to enclose the system and define the box base. The side and end panels are selected to have a similar length and width to the mattress/mattress base, but can be interchanged for different mattress/mattress base sizes (lengths and widths).

When the hoist is collapsed/retracted a lower edge of each of the side and end panels rests on the floor 20. The side and end panels can thus receive the weight of the upper frame independently of the hoist and thus independently receive bed loads applied thereto.

Referring specifically to FIG. 7, a support 42 is shown that can optionally be attached to extend between a transverse central member of the lower frame 18 and the transverse member 43 of the upper frame 14. The support 42 provides support to an intermediate central region of the upper frame (and thus overlying mattress base) when the hoist is collapsed/retracted.

In use of the bed lifting system 10, 10', a mattress base 22 is located (and eg. fastened) on the upper frame 14 (and optionally fastened to the arms 32) as shown in FIG. 3. When the need arises to raise the bed, a user activates the hoist 12 and both the upper frame and the framework or box base are elevated to a suitable position. This makes for easy bed making, servicing, etc.

When it is desired that the bed be lowered, the user reverses the lifting mechanism such that the upper frame and the base are lowered to the initial starting position. In the starting (collapsed/retracted) position the weight of the frame 14, mattress base 22 etc are now, independently of the hoist, transferred to and supported by the framework or box base.

The upper frame 14 and/or lower frame 18 can also be adapted for retrofitting to an existing base framework or box base (eg. a known mattress box base or a known separate frame). Such framework or box base can be modified (eg. in-situ) to facilitate such retrofitting (eg. plates, apertures, fasteners etc provided to facilitate attachment to the flanges 34).

In addition, the system can be operated whereby the framework or box base can remain located at the floor when the hoist is activated. In this regard, the framework or box base can eg. be connected to the lower frame 18. In such case, in the collapsed/retracted (eg. starting) position of the hoist the weight of the frame 14, mattress base 22 etc can still, independently of the hoist, be transferred to and supported by the framework or box base.

Whilst specific embodiments of the bed lifting system and components therefor have been described it should be appreciated that the bed lifting system can be embodied in many other forms.

The invention claimed is:

1. A bed lifting system for lifting a bed above a surface, comprising:

a frame having at least one outwardly extending arm arranged to extend from or retract into the frame to vary the width of the frame, the frame arranged for interacting with a lifting mechanism capable of elevating the frame to support a bed; and a base that is adapted for inter-engaging with the frame and comprising opposing elongate side members for positioning at opposing respective sides of the frame, each side member being adapted for resting on the surface through a plurality of spaced legs which extend downwardly to the surface such that the base can support the frame over the surface independently of the lifting mechanism.

2. The bed lifting system according to claim 1, wherein the legs are detachable and adapted for being attached to either or both ends and/or a mid-region of the frame.

3. The bed lifting system according to claim 1, wherein the frame has at least two outwardly extending arms located at opposing ends thereof, and wherein opposing ends of the side members are adapted for engaging remote ends of the arms.

4. The bed lifting system according to claim 3, wherein the opposing ends of the side members can be engaged to the arm ends via complementary fixing brackets mounted at each of the member and arm ends.

5. The bed lifting system according to claim 4, wherein the complementary fixing brackets comprise one or both of:

an in-use vertical plate affixed to each of the side member and arm end which plates can be arranged for fixing to each other;

an in-use horizontal plate affixed to each of the side member and arm end which plates can be arranged for fixing to each other.

6. The bed lifting system according to claim 4, wherein the opposing ends of the side panels can be engaged to the arm ends via a fixing bracket mounted at each arm end.

7. The bed lifting system according to claim 6, wherein the fixing bracket comprises one or both of:

an in-use vertical plate affixed to the side member and arranged for fixing to an inside face of the panel;

an in-use horizontal plate affixed to the side member and arranged for fixing to an upper edge of the panel.

8. The bed lifting system according to claim 1, wherein the outwardly extending arms are arranged to telescopically extend or retract with respect to the frame.

9. A base that is adapted for engaging a bed lifting apparatus, the base comprising:

telescope arms to vary the width of the bed lifting apparatus; and opposing elongate side members or panels for positioning at opposing respective sides of a frame mounted to the lifting apparatus, each side member or panel being adapted for resting on a surface when the lifting apparatus is in a collapsed/retracted position such that the base is able to, independently of the apparatus, support a bed on the surface.

10. The base as claimed in claim 9, further comprising end supports or panels for positioning at opposing respective ends of the frame and adapted for resting on the surface when the lifting apparatus is in a collapsed/retracted position.

11. A bed lifting system for lifting a bed above a surface, comprising:

a frame having at least one outwardly extending arm arranged to extend from or retract into the frame to vary the width of the frame, the frame arranged for interacting with a lifting mechanism capable of elevating the frame to support a bed; and a base that is adapted for inter-engaging with the frame and comprising opposing elongate side panels for positioning at opposite respective sides of the frame, each side panel being arranged for resting on the surface such that the base can support the frame over the surface independently of the lifting mechanism.

12. The bed lifting system according to claim 11, wherein the base further comprises opposing end panels for positioning at opposite respective frame ends, each end panel being arranged for resting on the surface and adapted for interacting with the side panels to enclose the frame.

13. A bed lifting system for lifting a bed above a surface, the system comprising:

a frame adapted for supporting the bed and for engaging a base of the bed, the frame having at least one outwardly extending arm arranged to extend or retract into the frame to vary the width of the frame;

a base extending downwardly from the frame to support the frame on the surface; and a lifting mechanism supported on the surface and arranged to interact with the frame so as to be capable of lifting the frame and the base above the surface.

* * * * *